US008522501B2

(12) United States Patent
King

(10) Patent No.: US 8,522,501 B2
(45) Date of Patent: Sep. 3, 2013

(54) CONCRETE WELDMENT

(76) Inventor: Ming-Ta King, Chicago, IL (US)

( * ) Notice: Subject to any disclaimer, the term of this patent is extended or adjusted under 35 U.S.C. 154(b) by 0 days.

(21) Appl. No.: 12/931,382

(22) Filed: Jan. 29, 2011

(65) Prior Publication Data

US 2012/0192506 A1 Aug. 2, 2012

(51) Int. Cl.
*E04B 5/04* (2006.01)

(52) U.S. Cl.
USPC ..... 52/601; 52/582.1; 52/125.4

(58) Field of Classification Search
USPC ..... 52/578, 601, 125.4, 850, 851; 249/83, 249/96, 97; 264/35, 265
See application file for complete search history.

(56) References Cited

U.S. PATENT DOCUMENTS

| | | | | |
|---|---|---|---|---|
| 3,958,954 | A * | 5/1976 | Ehlenbeck | 428/584 |
| 4,823,527 | A * | 4/1989 | Harbeke | 52/220.8 |
| 4,930,677 | A * | 6/1990 | Jolliffee | 228/120 |
| 5,402,616 | A * | 4/1995 | Klein | 52/601 |
| 6,185,897 | B1 * | 2/2001 | Johnson et al. | 52/583.1 |
| 6,668,506 | B2 * | 12/2003 | Snauwaert | 52/583.1 |
| 6,854,232 | B2 * | 2/2005 | Snauwaert | 52/582.1 |
| 7,461,492 | B1 * | 12/2008 | Francies et al. | 52/704 |
| D619,885 | S * | 7/2010 | Hansort | D8/382 |
| 7,934,343 | B2 * | 5/2011 | Fletcher et al. | 52/125.5 |
| 2003/0140590 | A1 * | 7/2003 | Lancelot et al. | 52/712 |
| 2007/0056242 | A1 * | 3/2007 | Sample | 52/698 |

* cited by examiner

*Primary Examiner* — Brian Glessner
*Assistant Examiner* — Adam Barlow
(74) *Attorney, Agent, or Firm* — Knectel, Demur & Samlan

(57) ABSTRACT

A weldment that is embedded in a concrete slab-type structural member. There is a central plate having a planar, weldable surface and disposed along an outer edge of the concrete slab. A pair of divergingly extending arms extends from the weldable surface and is embedded in the concrete slab. One or both of the extending arms has an irregular upper edge to engage the surrounding concrete. The irregular edge may be a series of v-shaped notches or v-shaped raised portions or any combination forming a saw tooth configuration. A method of manufacturing the weldment in the concrete slab is accomplished by locating the weldment in a mold and fastening a cap around the central plate. The weldment and cap are attached to the mold. After the concrete is poured and hardens into the slab, the cap is removed exposing a clean weldable surface.

2 Claims, 6 Drawing Sheets

CONCRETE WELDMENT

FIELD OF THE INVENTION

This invention relates to a metal weldable piece that is embedded into a concrete slab type structure and the method of manufacturing the slab so that the weldable piece is properly positioned in the slab. The weldable piece is used to join adjacent concrete structures or slabs by welding together the weldable piece embedded in each of the concrete structures.

BACKGROUND AND SUMMARY OF THE INVENTION

Precast concrete slab type structures are commonly used in constructing walls, floors, and concrete decks. They generally take the shape of concrete slabs which may have a t-shape in cross section. There is a horizontal portion of the slab which is the load bearing surface and there is generally reinforcing mesh or bars within the slab. There is at least one generally flat surface or edge that adjoins a flat surface or edge of a confronting adjacent slab.

When the concrete slabs are placed next to each other to form the wall or deck, it is possible for the slabs to move with respect to each other. This is due to wind forces or thermal expansion. In order to prevent or minimize the relative movement and to increase the strength of the final structure, metal inserts, often called "weldments" are place within the concrete slabs with a portion of the weldment extending out from an edge of the slab. When the slabs are positioned for final assembly, the metal weldment of one slab is aligned with and opposite to a complementary metal weldment in an adjacent slab. The metal complementary weldments are welded to each other to join the two weldments. This results in a unitary structure that is much stronger and less prone to movement than if no method of joining the slabs were used.

Various types of weldments have been used in the past. One such type is a U-shaped cylindrical reinforcing bar that had the arms of the "U" embedded within the concrete and the base of the "U" exposed along the edge of the concrete slab. Because the exact position of the arms could not be maintained when the concrete slab was poured, and the "U" shaped reinforcing bar did not have adequate means to keep it secured within the concrete slab, the reinforcing bar oftentimes pulled out from the slab when under load. Obviously this was unacceptable as it substantially weakened the overall structure.

An improved weldment is illustrated in U.S. Pat. No. 5,402,616. This weldment provides a weldment that has arms that support a reinforcing mesh within the concrete mold during the molding operation. The mesh is accurately positioned and retained in the proper position during the molding operation so that it buried in the concrete slab at a proper depth and a predetermined distance from the edge of the slab. However, a problem with this particular weldment, which is similar to the problem in the other prior art weldments, is securing the weldment within the concrete slab at all times. Horizontal and vertical forces tend to loosen the weldment within the slab which can eventually cause the weldment to be pulled out from the slab.

Another problem in the past was positioning the weldment into the mold that is used to form the concrete slab. Not only must the weldment be accurately positioned and have that position maintained when the concrete is poured, but the face of the weldment that is to be welded, must be kept relatively clean from concrete so that it is ready for welding. This presents additional problems during the casting process.

Thus, there is the need for a concrete weldment having improved securing properties over the weldments illustrated in the prior art that causes the weldment to be more securely retained within the concrete slab even when the weldment is subjected to vertical and horizontal forces. It is an object of the invention to provide a concrete having these properties, yet are not more expensive to manufacture than weldments of the prior art. There is also a need for an improved positioning mechanism to maintain the weldment in the proper position during the concrete casting process and further to keep the weldable face of the weldment as clean as possible. This results in an increased weldable area, at the proper angle to the concrete surface, and allows for thermal expansion of the weldment without cracking and spalling of the concrete.

Applicant's invention solves the problem stated above by designing a weldment that comprises a central plate which defines the weldable surface. The central plate is at an acute angle with respect to the horizontal plane of the concrete slab. There is a pair of outstanding arms extending out from the each of the ends of the central plate. Each of the outstanding arms has a top edge and a bottom edge. In one embodiment there is an irregular surface along the top edge of one or both of the outstanding arms. The irregular surface can be a v-shaped cut or a saw-tooth cut in the top edge. This irregular surface provides a locking or high friction surface against which the weldment locks into the concrete slab as the poured concrete hardens. The resulting locking edges of the arms further increases the force required to pull the weldment from the concrete slab as compared to those of the prior art.

Applicant's invention also provides for a cap or cover that is attached to the central plate prior to the casting process. The cap is further attached to the steel mold that defines the concrete slab. This cap covers the weldable surface and top and bottom edges of the central plate and accurately positions the weldment within the mold. After the concrete slab is poured and hardens, the cap is removed from the central plate, which presents a clean weldable surface. A recess is also formed in the concrete slab around the central plate to allow for thermal expansion when it is welded.

DESCRIPTION OF THE PREFERRED EMBODIMENT

Figure 2:
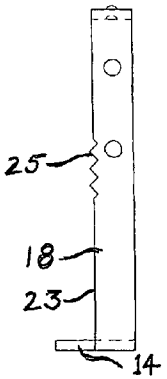
FIG. 2 is an end view of the weldment shown in FIG. 1.
Figure 1:
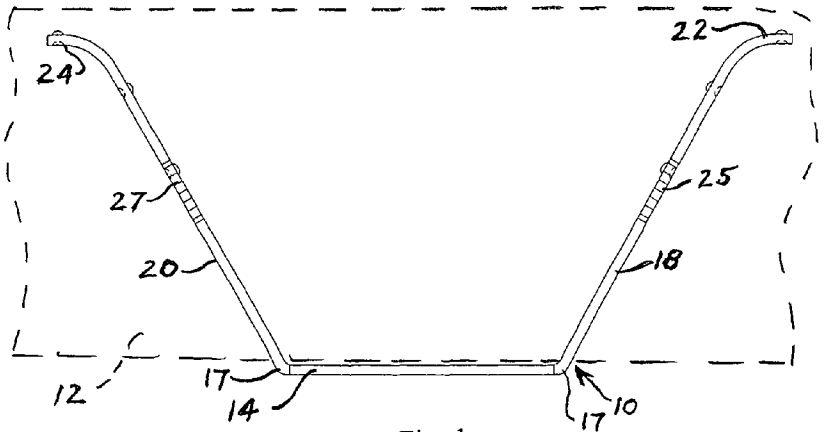
FIG. 1 is top plan view of the inventive weldment.

Turning first to FIG. 1 there is illustrated a weldment 10 of the present invention. It is designed to be embedded in a concrete slab-type structural member or slab 12. The slabs 12 are generally designed having an extended length as compared to its width. The slabs 12 are generally positioned so that the long edges of the slabs are abutting each other to form a building element such as a wall or deck surface. The weldments 10 are placed at predetermined distances along the long edge of the slab 12. When the slabs are placed adjacent to each other, the weldments 10 are in close proximity to each other such that they can be welded together thereby increasing the strength overall wall or deck surface. Furthermore the horizontal shear capacity of the weldment will provide the shear requirement to make the slabs 12 act as one diaphragm when welded together.

The weldment 10 has a central plate 14. There is a top edge 15 that is preferably not embedded in the slab 12. Opposite the top edge 15 is a bottom edge 16, the top and bottom edges 15 and 16 defining the height $H_1$ of the central plate 14. The central plate 14 has a width $W_1$ which terminates in opposite ends 17 from which extend diverging arms 18, 20. The arms 18, 20 have a bottom have a bottom edge 21 which is in the same plane as the bottom edge 16. The arms 18, 20 also have a top edge 23 with irregular surface portions 25 and 27 respectively. Out-turned flanges 22, 24 are connected to the ends of the arms 18, 20 opposite ends 17. The plane of the flanges 22, 24 are substantially parallel to plane of the central plate 14.

Figure 3:
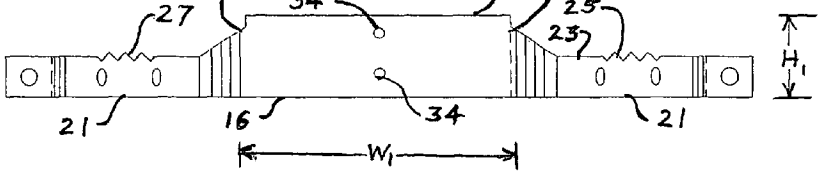
FIG. 3 is a front elevation view of the weldment.

As seen in FIG. 3 there are holes 34 which receives a fastener such as a rivet or self-tapping screw which accurately positions and holds the weldment 10 during the concrete slab manufacturing process. The weldment 10 is positioned in a mold and held in place so that when the concrete is poured into the mold, the weldment 10 remains in its proper position so that it is accurately embedded within the concrete. This will be more fully described herein when the casting process is described.

Figure 4:
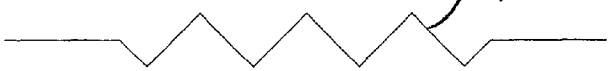
FIG. 4 is an enlarged view of the saw tooth edge.

The irregular portions 25 or 27 can take numerous shapes and configurations. As illustrated in FIGS. 3 and 4, the irregular portions 25, 27 can be a v-shaped notch or elevated v portion or any saw tooth configuration in the top edge 23. The irregular portion can be on the top edge 23 of one or both of the diverging arms 18, 20. The purpose of the irregular portions 25 or 27 is to provide a locking or resistance portion on the arms 18, 20 which interacts with and interlocks with the concrete after it is poured and hardens. These irregular portions make it much more difficult for the weldment 10 to loosen from the concrete 12 as the horizontal tensile capacity of the weldment is significantly increased due to the saw tooth edge at one or both arms.

Figure 5:
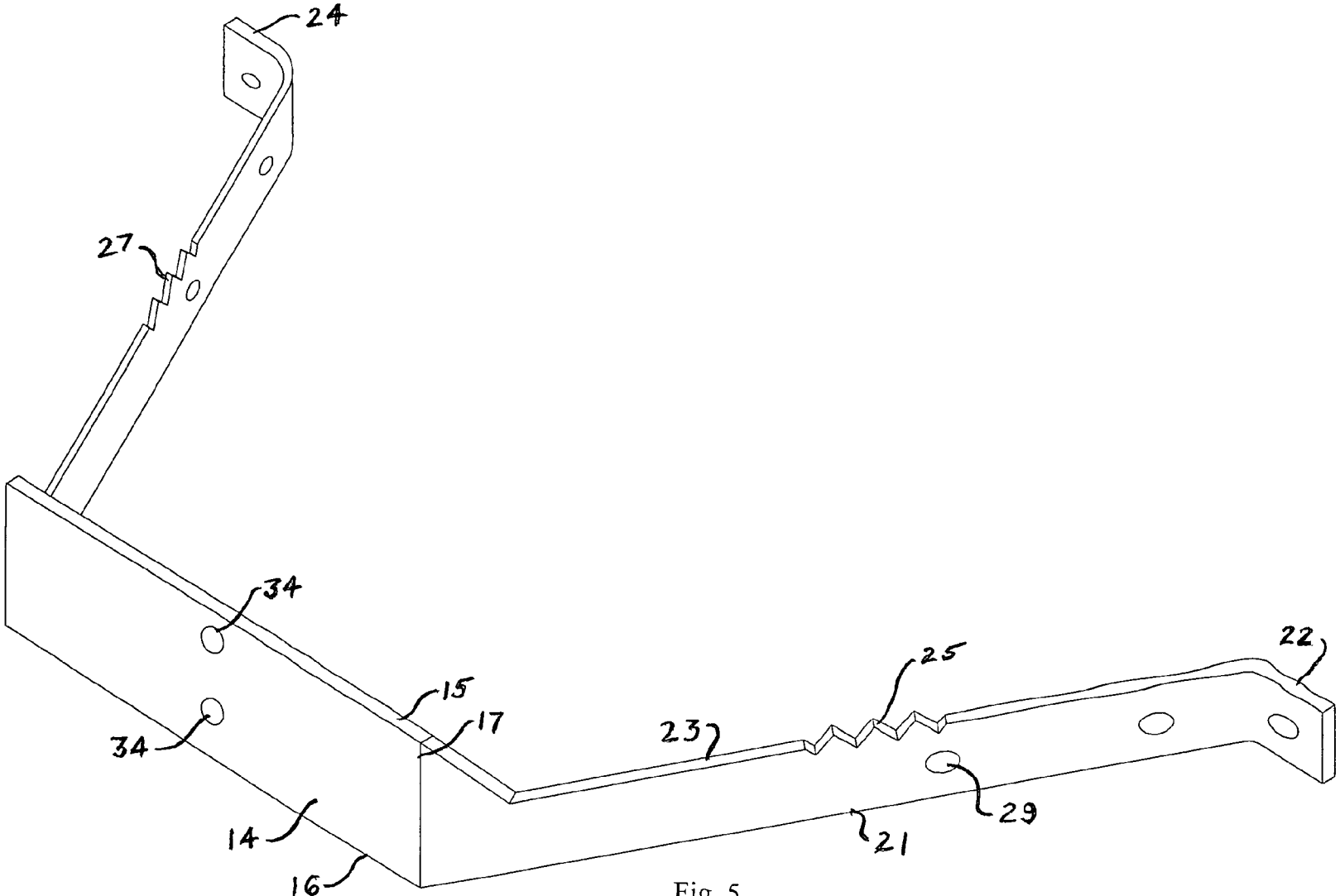
FIG. 5 is a perspective view of the weldment.

FIG. 5 is a perspective view of the weldment 10. Dimples or raised portions 29 may be added along the arms 18, 20. The dimples 29 provide additional means to anchor the weldment 10 in the concrete slab 12 by providing an additional raised surface to interact with the concrete slab 12. This makes it more difficult to pull the weldment 10 out of the slab 12.

Figure 6:
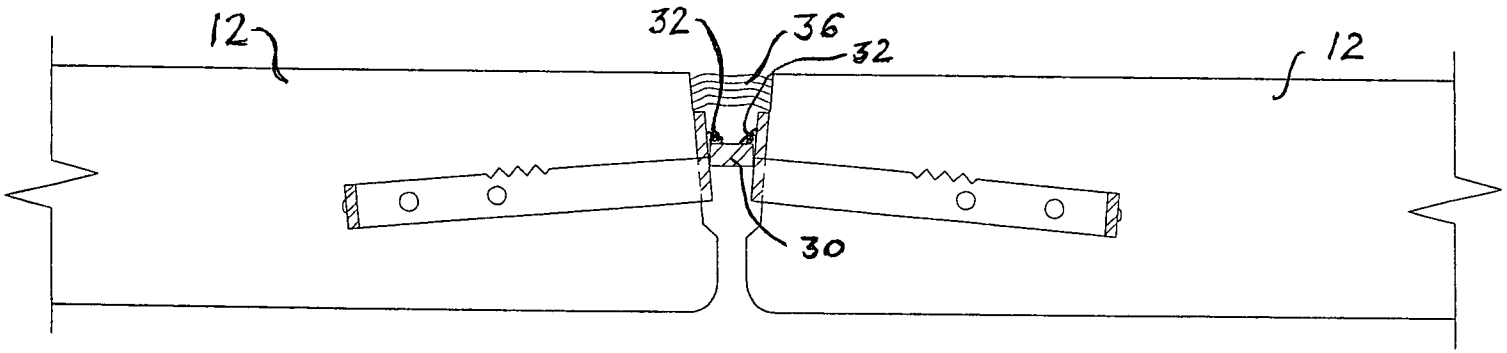
FIG. 6 is a side view of two concrete slabs each having a weldment embedded within, with the exterior face of the central portions facing each other.

Turning to FIG. 6, there are illustrated two concrete slabs 12 in face to face orientation. Each slab 12 has a weldment 10 embedded within the slab 12. The central plate 14 of each weldment 10 faces the other. With the two slabs 12 slightly separated by approximately ½ inch, a welding plate 30 is placed between the two central plates 14. A weld 32 is made between the plate 30 and the central plate 14 so that a unitary structure is created by the two central plates 14, the welding plate 30 and the weld 32. After the weld 32 cools, a sealant 36 is placed in the void between the two concrete slabs 12, above the welding plate 30 and up to the top surface of the concrete slabs 12.

Figure 7:
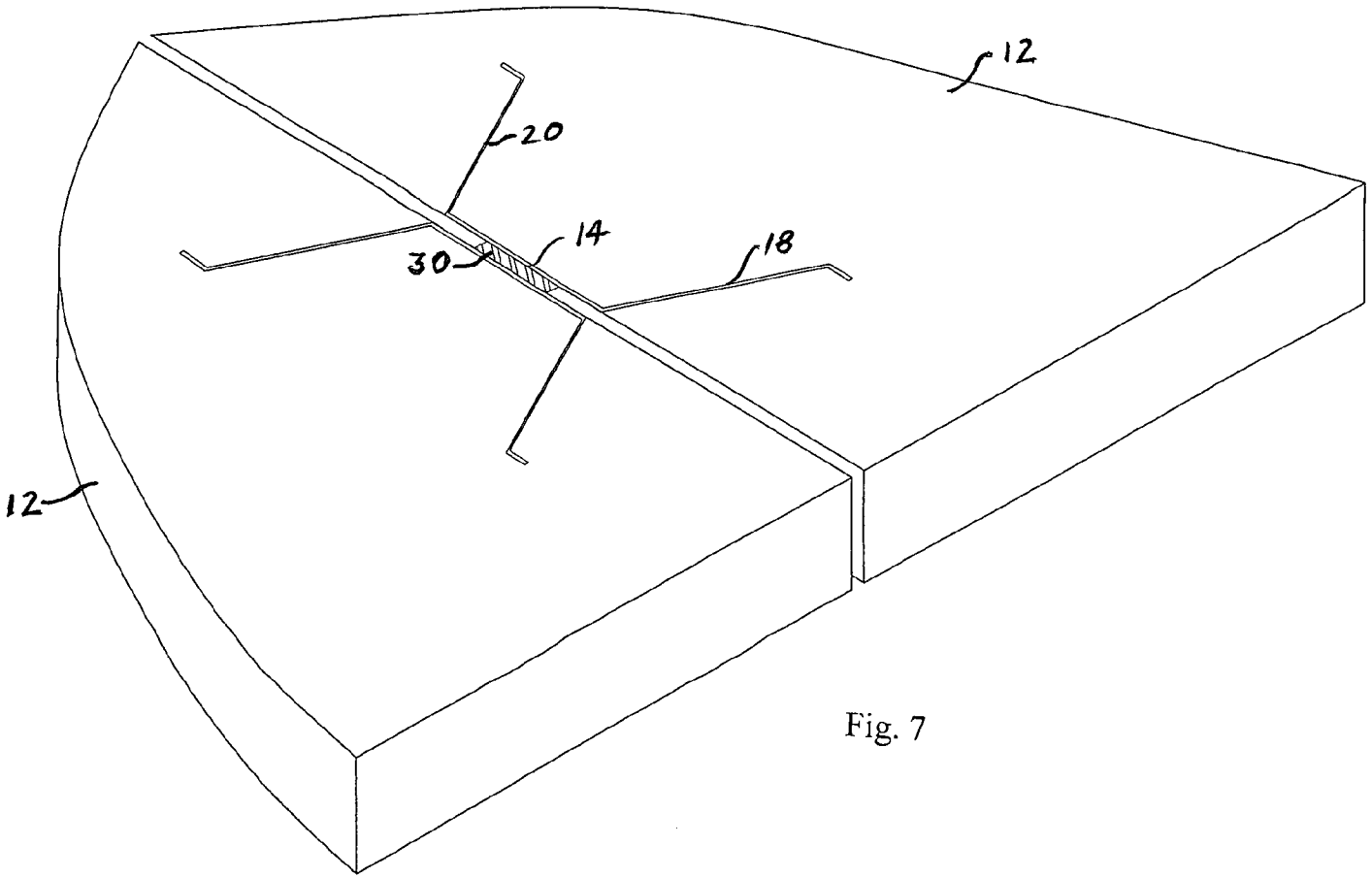
FIG. 7 is an isometric view of two adjacent concrete slabs illustrating the position of the weldments in each slab with respect to each other.
Figure 9:
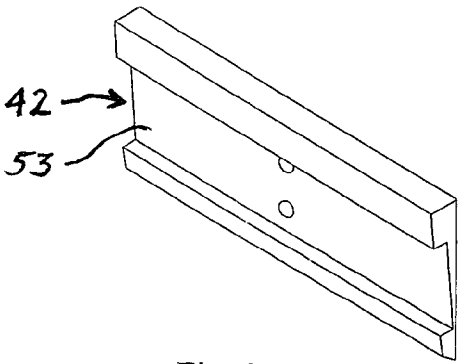
FIG. 9 is a perspective view of the cap.

FIG. 7 is similar to FIG. 6 except it is an isometric view with portions removed illustrating the position of the weldments 10 when the two concrete slabs 12 are facing each other. The welding plate 30 is positioned between the two slabs 12 and supported by the central plate 14. Once the weld 32 is made, the two concrete slabs 12 act as one unitary structure. It resists horizontal shear in both horizontal directions as illustrated by arrows $F_1$, $F_2$, $F_3$, and $F_4$. Furthermore this configuration increases the vertical shear capacity of the weldment 10 as the outturned flanges 22, 24 assist in distributing the vertical load from one concrete slab to another without spalling the concrete. The result is the entire floor structure of the joined concrete slabs acts as one unit.

Figure 8:
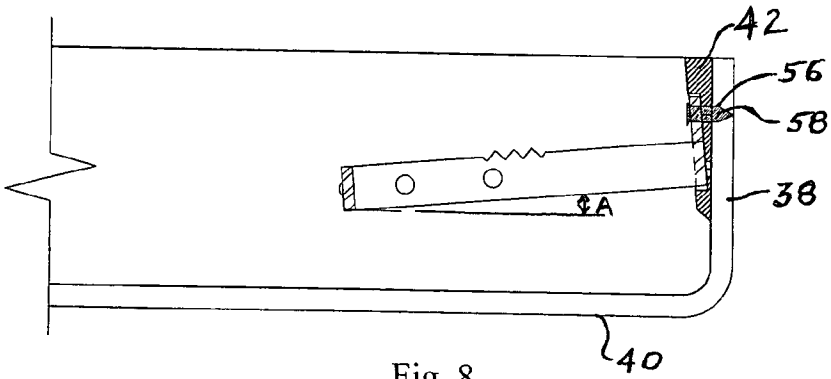
FIG. 8 is side view with portions removed of the weldment mounted to the mold with the cap covering the front surface of the central portion of the weldment.
Figure 11:
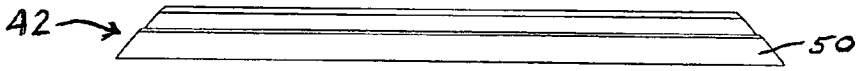
FIG. 11 is a bottom view of the cap.
Figure 10:
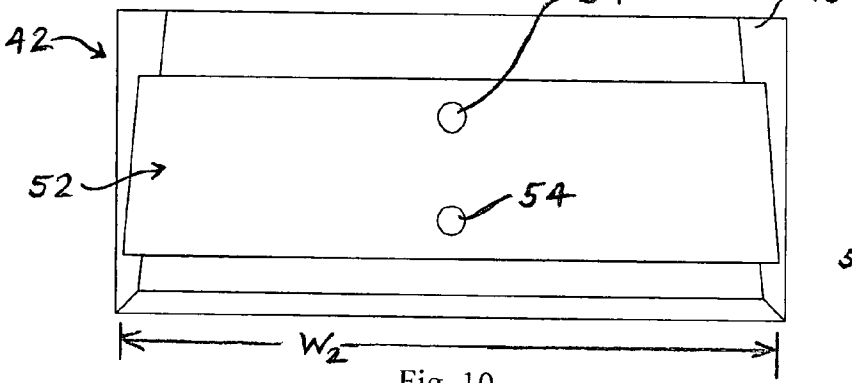
FIG. 10 is a front view of the cap.
Figure 13:
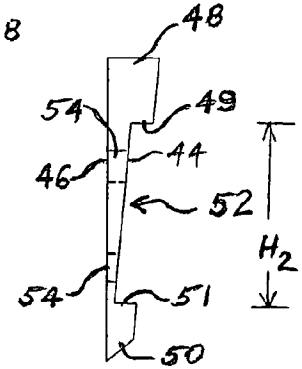
FIG. 13 is a left end view of the cap.
Figure 12:
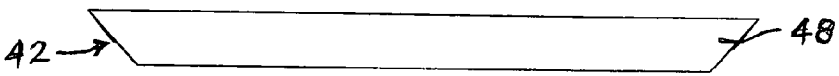
FIG. 12 is top plan view of the cap.

To illustrate the concrete slab manufacturing process we turn to FIG. 8 which illustrates a mold or steel form 38 used to make the concrete slab 12. The mold 38 has a mold bottom 40 which defines the edges and outer dimensions of the length and width of the concrete slab 12. To manufacture the concrete slab 12, the weldment 10 is first attached to a cap or cover 42. The cap 42 is illustrated in detail in FIGS. 10-13. As seen in FIG. 13, the cap 42 has a front 44, a back 46, a top 48 and a bottom 50. The top 48 terminates on one side at a top ledge 49 and the bottom terminates at on one side at a bottom ledge 51. Between the top ledge 49 and bottom ledge 51 is a recessed area 52. A height $H_2$ of the recessed area 52 is slightly larger than the height $H_1$ of the central plate 14. It is dimensioned to closely receive the central plate 14 as seen in FIG. 8. A width $W_2$ of the recessed area 52 is slightly greater than the width $W_1$ of the central plate 14.

In FIG. 13 it is seen that there are cap rivet holes 54 that extend from the back 46 to the front 44. When the weldment 10 is located between the top ledge 49 and bottom ledge 51, with the central plate 14 placed in the recessed area 52, the rivet holes 34 area aligned with the cap rivet holes 54. Furthermore, the mold 38 has receiving holes 56 that align with holes 54. Thus, when a fastener or rivet 58 is placed through the river holes 34, through aligned cap holes 54 and then into the mold holes 56, the weldment 10 is properly placed and oriented within the mold 38. As can be seen in FIG. 13, the back wall of the recessed area 53 is at an acute angle with respect to the front 44. When the cap 42 is attached to the mold 38, the angle of the back wall 53 causes the weldment 10 to be disposed at an acute angle A with respect to the horizontal. This results in the weldment 10 being disposed at the acute angle A with respect to the bottom of the mold as illustrated in FIG. 8. This angular displacement of the weldment 10 with respect to a horizontal plane increases the shear forces necessary to dislodge the weldment from the concrete slab 12. Furthermore this orientation allows greater room for other concrete slab reinforcements as are commonly used in the art to be placed on the arms 18 and 20 then if the arms are in a horizontal position with respect to the concrete slab 12.

Once the weldment 10 is properly positioned within the mold 38 as described above, concrete is poured into the mold 38 to the proper height of the concrete slab. In the preferred embodiment, it is preferable for the weldment to be approximately ¾ inches from the top of the concrete slab for ease of welding. Once the concrete hardens, the slab 12 is removed from the mold 38. The cap 42 is pulled off the central plate 14 exposing the fasteners or rivets 58. These are then sheared off flush with the surface of the central plate 14. The result is a clean weldable surface on the central plate 14. As the rivets 58 remain in the holes 34 during the concrete pouring, no concrete fills the holes, or is there concrete coming through the holes 34 toward the surface of the central plate 34 such as found in the prior art. This is advantageous as it minimizes spalling or cracking of the concrete during the welding process. Furthermore, it can be seen that when the cap 42 is removed from the central plate 14, there is a recess or void area around the top edge 15 and bottom edge 16. This is advantageous in that this void area allows for expansion and contraction of the central plate 14 during the welding operation without spalling or cracking the surrounding concrete. The cap 42 is reusable as no destruction of the cap takes place during the manufacturing of the concrete slabs.

Thus there has been provided a weldment to be embedded within a concrete slab and a method of manufacturing the concrete slab that fully satisfies the objects set forth above. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A metal weldment embedded in a concrete slab-type structural member that is formed in a mold, the concrete slab-type structural member having a horizontal base and vertical upstanding side walls, the weldment comprising:

a central plate of a first height and opposite ends and a planar, weldable from surface having top and bottom edges, the planar surface disposed at an acute angle to the vertical plane of the upstanding edge of the concrete slab-type structural member, the planar surface further disposed along an edge of the concrete slab-type structural member;

a pair of outstanding arms, each arm having a length and extending divergingly outward from one of the ends of the central plate and having top and bottom edges and a second height, the second height of the arms being less than the first height of the central plate, the arms supporting a reinforcing structure within the concrete slab-type structural member, the second height of the arms being selected to support the reinforcing structure at a predetermined height, end flanges extending out from each of the ends of the arms in a plane substantially parallel to the plane of the central plate for further securing the weldment inside the concrete slab-type structural member, the end flanges being of the same height as the second height of the outstanding arms, at least one irregular edge on the top edge of each of the extending arms, the irregular edge providing an irregular surface to engage the surrounding concrete slab-type structural member for aiding in retaining the weldment within the concrete slab-type structural member, a cap for protecting the weldable surface and top and bottom edges of the central plate from concrete being poured during the casting of the concrete slab-type structural member, the cap attached to the central plate by means of a fastener which passes through complementary holes in the central plate and the cap, the fastener positioning the weldment in the mold, wherein the cap is a U-shaped cap comprised of two legs and a base configured in a U-shape in cross section with one leg of the U covering the top edge and the other leg of the U covering the bottom edge of the central plate, the base of the U-shaped cap covering the weldable front surface of the central plate, the central plate being closely received in the cap, and the base of the U-shaped cap is configured at an acute angle to the vertical upstanding side wall of the slab so that when the weldment is attached to the cap, and the cap is attached to the mold, the length of the outstanding arms is at an acute angle to the horizontal base of the concrete slab-type structural member, and the holes in the center plate being substantially free of concrete when the fastener is removed from the central plate and cap after the concrete slab-type structural member is formed.

2. The weldment of claim 1 wherein the irregular edge comprises a saw tooth cut on the edge of arm.

* * * * *

UNITED STATES PATENT AND TRADEMARK OFFICE

CERTIFICATE OF CORRECTION

PATENT NO. : 8,522,501 B2
APPLICATION NO. : 12/931382
DATED : September 3, 2013
INVENTOR(S) : Ming-Ta King It is certified that error appears in the above-identified patent and that said Letters Patent is hereby corrected as shown below:

In the Claims

In column 5, Claim 1, line 23 please delete the word "from" and insert the word --front--.

Signed and Sealed this
Fifteenth Day of October, 2013

Teresa Stanek Rea

Teresa Stanek Rea
*Deputy Director of the United States Patent and Trademark Office*